United States Patent [19]

Bradley et al.

[11] 4,090,304

[45] May 23, 1978

[54] GAUGE FOR ALIGNING THE MOLD OF A CONTINUOUS-CASTING MACHINE WITH A GUIDE ROLL-RACK

[75] Inventors: James G. Bradley, Center Township, Porter County, Ind.; Wilmer C. Wrhen, Cranberry Township, Venango County, Pa.

[73] Assignee: United States Steel Corporation, Pittsburgh, Pa.

[21] Appl. No.: 776,572

[22] Filed: Mar. 11, 1977

[51] Int. Cl.[2] ..... B21B 31/34

[52] U.S. Cl. ..... 33/182

[58] Field of Search ..... 33/182, 181 R, 146, 33/147 R, 172 D, 172 R, 174 L, 180 R

[56] References Cited

U.S. PATENT DOCUMENTS

| | | | |
|---|---|---|---|
| 890,453 | 6/1908 | Rice | 33/180 R |
| 2,742,993 | 4/1956 | Hommel et al. | 33/174 L |
| 3,962,794 | 6/1976 | King et al. | 33/182 |

FOREIGN PATENT DOCUMENTS

| | | | |
|---|---|---|---|
| 142,479 | 4/1962 | U.S.S.R. | 33/180 |

*Primary Examiner*—Richard E. Aegerter
*Assistant Examiner*—John W. Shepperd
*Attorney, Agent, or Firm*—Walter P. Wood

[57] ABSTRACT

A gauge for aligning the mold of a continuous-casting machine with a guide roll-rack beneath the mold. The gauge includes elongated bars and connecting links pivoted to the bars forming a parallelogram. Brackets are pivoted to one or more of the links and carry dial indicators. The bars have portions which have straight side edges for abutting the rolls of the roll-rack, and portions of reduced width to lie within the mold. The dial indicators have plungers for abutting the mold walls.

5 Claims, 3 Drawing Figures

GAUGE FOR ALIGNING THE MOLD OF A CONTINUOUS-CASTING MACHINE WITH A GUIDE ROLL-RACK

This invention relates to an improved gauge for aligning the mold of a continuous-casting machine with a guide roll-rack beneath the mold.

In a conventional continuous-casting operation, liquid metal is poured continuously into a vertically oscillating, water-cooled, open-ended mold, which may be either straight-sided or curved. A partially solidified casting of indefinite length emerges from the bottom of the mold and travels first through a guide roll-rack which includes series of closely spaced rolls engaging opposite faces of the casting for guiding and confining it. As the casting leaves the mold, it has only a thin solidified skin and a liquid core and it must be handled carefully to avoid defects in the finished product, or even breakouts of liquid metal. Hence it is essential that the mold is accurately aligned with the guide roll-rack.

An object of the present invention is to provide an improved parallelogram-type gauge for expeditiously and accurately aligning a straight-sided mold with a guide roll-rack.

Figure 1:
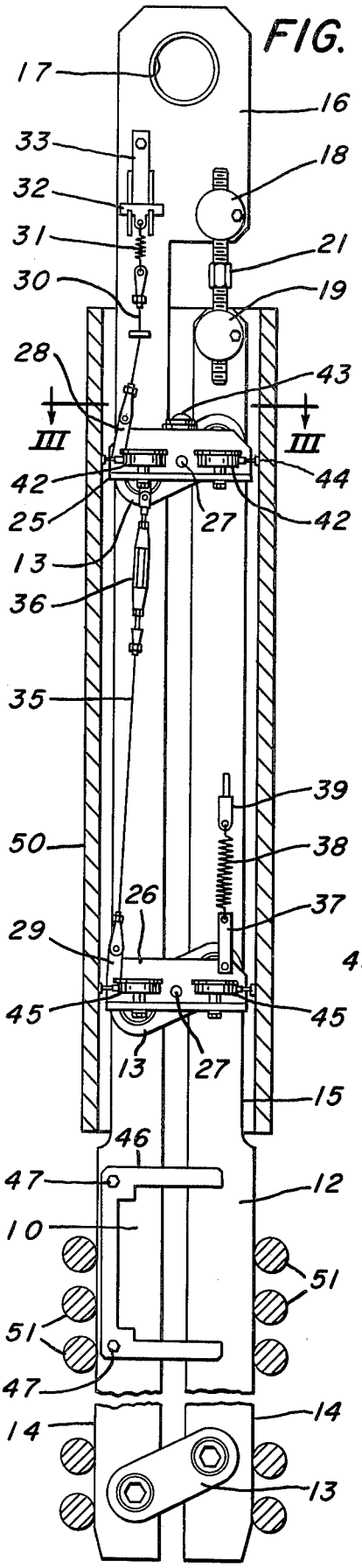
FIG. 1 is a front elevational view of a gauge constructed in accordance with our invention with parts of a continuous-casting machine indicated diagrammatically.

The gauge of our invention includes a pair of elongated parallel bars 10 and 12 and a plurality of connecting links 13 pivoted at their opposite ends to the respective bars to form a parallelogram. The lower portions of bars 10 and 12 have accurately formed straight side edges 14. The upper portions of the bars are of reduced width, as indicated at 15. The upper end of bar 10 forms an enlarged head 16 overlying the upper end of bar 12. The head 16 has a lifting eye 17. Tapped blocks 18 and 19 are pivoted to the head 16 and to the upper end of bar 12 respectively on pins 20. An adjusting screw 21, which has right and left handed threaded portions, is threadedly engaged with blocks 18 and 19. Thus turning the adjusting screw moves the bars 10 and 12 relative to each other and regulates the spacing therebetween. The links 13 constrain the bars as they move relative to each other, whereby their edges 14 always remain parallel.

Upper and lower brackets 25 and 26 are pivoted to two of the links 13 on pins 27. Links 28 and 29 are pivoted to the ends of the respective brackets 25 and 26 overlying bar 10. A flexible connector 30 is attached at its lower end to link 28 on bracket 25 and at its upper end to a spring 31 through suitable fittings. A T-shaped latch element 32 is attached to the upper end of spring 31. Bar 10 carries a latch bracket 33, the upper edges of which have series of notches 34 of varying depth for receiving the latch element 32. Another flexible connector 35 is attached at its lower end to link 29 on bracket 26 and at its upper end to a turnbuckle 36 which is attached to the underside of bracket 25, all through suitable fittings. Another link 37 is pivoted to the end of the lower bracket 26 overlying bar 12. A spring 38 is attached at its lower end to link 37 and at its upper end to a clip 39 fixed to bar 12.

Figure 2:
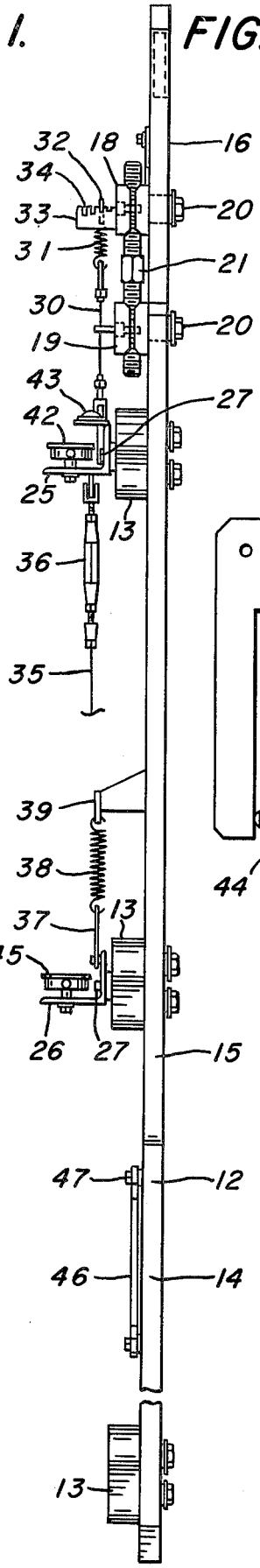
FIG. 2 is a side elevational view of the gauge taken from the right of FIG. 1.
Figure 3:
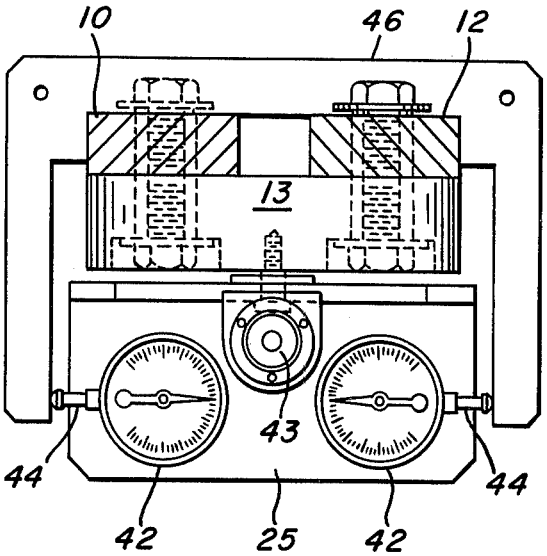
FIG. 3 is a horizontal section on a larger scale on line III—III of FIG. 1.

As best shown in FIG. 3, the upper bracket 25 carries a pair of opposed dial indicators 42 and a bubble level 43. The dial indicators have outwardly directed plungers 44. The lower bracket 26 carries similar dial indicators 45. FIG. 3 shows a U-shaped zeroing gauge 46 positioned over the dial indicators 42 for accurately adjusting them to a zero position. The distance between the arms of the zeroing gauge matches the width of the mold with which our gauge is used. For storage the zeroing gauge can be fixed to one of the bars 10 or 12 with bolts 47, as shown in FIGS. 1 and 2.

FIG. 1 shows diagrammatically a straight-sided liner 50 of the mold of a continuous-casting machine, and series of rolls 51 of a guide roll-rack beneath the mold. The machine of course includes other conventional parts which are not shown since they are not involved in our invention. We assume that the guide roll-rack already is properly positioned and the mold is to be aligned therewith.

When our gauge is not in use, we disengage the T-shaped latch element 32 from its cooperating bracket 33, and we turn the adjusting screw 21 to draw the bars 10 and 12 together. The spring 38 pulls the lower bracket 26 to a counterclockwise position, and the lower bracket acts through the flexible connector 35 to pull the upper bracket 25 to a similar counterclockwise position. With the parts thus positioned, we lower the gauge into the mold 50 and discharge rack 51, as shown in FIG. 1. The portions of the bars 10 and 12 which have the straight side edges 14 lie within the roll-rack 51, and the portions 15 of reduced width lie within the mold 50.

Next we turn the adjusting screw 21 to spread the bars 10 and 12 until their edges 14 abut the rolls at each side of the roll-rack 51. We engage the T-shaped latch element with the appropriate notches 34 in bracket 33 to pull the brackets 25 and 26 to a level clockwise position, as indicated by the level 43. The plungers 44 of the dial indicators now contact the opposite faces of the mold 50. We shift the mold sideways as needed to align it with the roll-rack 51. The reduced width of the portions of the bars within the mold permit the mold to be shifted to the extent necessary. The position of alignment is indicated when all four dial indicators 42 and 45 read the same. The dimension of the mold in a direction transverse to the plane of FIG. 1 is sufficiently large that visability of the lower dial indicators 45 is not blocked.

From the foregoing description it is seen that our invention affords a simple gauge which is easy to use and which enables a straight sided mold to be accurately aligned with a guide roll-rack. We are able to achieve an accuracy of $\pm$ 0.005 inch in aligning a mold with our gauge.

We claim:

1. A gauge for aligning the mold of a continuous-casting machine with a guide roll-rack beneath the mold, said gauge comprising:

a pair of elongated bars, a plurality of connecting links, and means pivoting said links to said bars forming a parallelogram;

said bars having portions with straight side edges for abutting the rolls of a guide roll-rack and portions of reduced width to lie within a mold;

means connected to said bars for adjusting the spacing therebetween;

first and second brackets, and means pivoting each of said brackets to a different one of said links;

a respective pair of opposed dial indicators carried by each of said brackets and having plungers for abutting the mold walls; and means connected with said brackets for moving them between a position in which said bars can be lowered into a mold and a position in which said plungers abut the mold walls.

2. A gauge as defined in claim 1 in which one of said bars has a head at its upper end overlying the upper end of the other bar, and said means for adjusting the spacing of said bars includes respective blocks, means pivoting said blocks to said head and to said other bar, and an adjusting screw threadedly engaging said blocks.

3. A gauge as defined in claim 1 comprising means connecting said brackets for moving said second bracket with said first-named bracket.

4. A gauge as defined in claim 3 comprising spring means connected to said second bracket normally moving said brackets to positions in which the gauge can be lowered into a mold, and latch means connected to said first-named bracket for holding said brackets in positions in which said plungers abut the mold walls.

5. A gauge as defined in claim 1 comprising in addition a bubble level carried by said first bracket.

* * * * *